US011162296B2

(12) United States Patent
Povilaitis

(10) Patent No.: US 11,162,296 B2
(45) Date of Patent: Nov. 2, 2021

(54) WINDOW HAVING HINGED CORNER ARRANGEMENT

(71) Applicant: ALPINA MANUFACTURING LLC, Chicago, IL (US)

(72) Inventor: Darius A. Povilaitis, Chicago, IL (US)

(73) Assignee: ALPINA MANUFACTURING LLC, Chicago, IL (US)

( * ) Notice: Subject to any disclaimer, the term of this patent is extended or adjusted under 35 U.S.C. 154(b) by 0 days.

(21) Appl. No.: 16/692,525

(22) Filed: Nov. 22, 2019

(65) Prior Publication Data

US 2021/0156194 A1 May 27, 2021

(51) Int. Cl.
*E06B 3/58* (2006.01)
*E06B 3/26* (2006.01)
(Continued)

(52) U.S. Cl.
CPC ..... *E06B 3/5871* (2013.01); *E06B 3/26* (2013.01); *E06B 3/301* (2013.01); *E06B 3/308* (2013.01);
(Continued)

(58) Field of Classification Search
CPC ..... E06B 3/5871; E06B 3/26; E06B 3/301; E06B 3/308; E06B 3/5885; E06B 3/964;
(Continued)

(56) References Cited

U.S. PATENT DOCUMENTS 349,631 A * 9/1886 Cutts ..... B44D 3/185 160/374.1
1,242,815 A * 10/1917 Kohler ..... E06B 3/9646 52/800.16
(Continued)

FOREIGN PATENT DOCUMENTS

DE 10029916 A1 12/2001
DE 102004053669 A1 * 5/2006 ..... E04H 15/46
(Continued)

OTHER PUBLICATIONS

Machine translation of foreign reference FR2556402, obtained from https://translationportal.epo.org/emtp/translate/?ACTION=description-retrieval&COUNTRY=FR&ENGINE=google&FORMAT=docdb&KIND=A1&LOCALE=en_EP&NUMBER=2556402&SRCLANG=fr&TRGLANG=en (last accessed on Oct. 21, 2020) (Year: 2020).*
Machine translation of foreign reference EP0952294, obtained from https://translationportal.epo.org/emtp/translate/?ACTION=description-retrieval&COUNTRY=EP&ENGINE=google&FORMAT=docdb&KIND=A2&LOCALE=en_EP&NUMBER=0952294&SRCLANG=de&TRGLANG=en (last accessed on Oct. 21, 2020) (Year: 2020).*

*Primary Examiner* — Theodore V Adamos
(74) *Attorney, Agent, or Firm* — Marshall, Gerstein & Borun LLP

(57) ABSTRACT

A structural assembly for a frame includes a first rail, a second rail, a third rail, a fourth rail, a first pivotable bracket member coupling the first and second rails, and a second pivotable bracket member coupling the third and fourth rails. The first rail includes a first end, a second end, and a first groove extending a distance between the first end and the second end thereof. The second rail includes a first end, a second end, and a second groove extending a distance between the first end and the second end thereof. The third rail includes a first end, a second end, and a third groove extending a distance between the first end and the second end thereof. The fourth rail includes a first end, a second end, and a fourth groove extending a distance between the first end and the second end thereof.

23 Claims, 4 Drawing Sheets

(51) Int. Cl.
*E06B 3/30* (2006.01)
*E06B 7/22* (2006.01)
*E06B 3/964* (2006.01)

(52) U.S. Cl.
CPC ..... *E06B 3/5885* (2013.01); *E06B 3/964* (2013.01); *E06B 7/22* (2013.01)

(58) Field of Classification Search
CPC ..... E06B 7/22; E06B 3/9644; E06B 3/9765; E06B 3/667; E06B 1/003; E06B 1/28; E06B 1/60; Y10T 403/725; Y10T 403/555; Y10T 403/42
See application file for complete search history.

(56) References Cited

U.S. PATENT DOCUMENTS 2,666,508 A * 1/1954 Nardulli ..... E06B 3/9688 52/656.9
3,208,553 A * 9/1965 Gray ..... E06C 1/32 182/24
3,317,227 A 5/1967 Nijhuis
4,222,209 A * 9/1980 Peterson ..... E06B 3/667 403/295
4,251,166 A * 2/1981 Lautenschlager ..... F16B 12/20 403/402
4,372,082 A 2/1983 Pagel
4,571,115 A * 2/1986 Erlebach ..... F16B 12/2036 403/295
4,822,205 A * 4/1989 Berdan ..... E06B 3/667 403/295
4,829,685 A * 5/1989 Persson ..... B44D 3/185 160/374.1
4,852,324 A * 8/1989 Page ..... F27D 1/145 52/506.02
5,048,997 A * 9/1991 Peterson ..... E06B 3/667 403/295
5,154,034 A * 10/1992 Stanek ..... E06B 3/685 403/84
5,350,038 A * 9/1994 Lazarus ..... E06C 1/12 182/163
5,775,460 A * 7/1998 Stone ..... E06C 1/12 16/354
8,272,178 B2 9/2012 Pardue et al.
8,966,839 B2 3/2015 Rebman et al.
9,580,954 B2 2/2017 Pardue et al.
10,196,850 B2 2/2019 Wexler
2002/0059758 A1* 5/2002 Dodson ..... E06B 1/6046 52/204.1
2003/0089054 A1* 5/2003 Hornung ..... E06B 3/24 52/204.62
2006/0248820 A1* 11/2006 Silverman ..... E06B 3/5871 52/204.1
2007/0199181 A1* 8/2007 Eichert ..... A47G 1/1666 16/404
2008/0072517 A1* 3/2008 Grazioso ..... E06B 3/9646 52/698
2010/0083468 A1* 4/2010 Lin ..... F21S 6/003 16/387
2010/0242400 A1* 9/2010 Sawyers ..... A47G 1/10 52/656.9
2016/0356076 A1* 12/2016 Isaacs ..... E06B 3/9682
2017/0265661 A1* 9/2017 Isaacs ..... A47G 5/04

FOREIGN PATENT DOCUMENTS

EP 0952294 A2 * 10/1999 ..... E06B 1/60
EP 2039868 A2 3/2009
FR 2556402 A1 * 6/1985 ..... E06B 3/9644

* cited by examiner 156
156d
124
156b
164
156a
152d
A
152
152a
124a
164
112b
160
152c, 156c
152a
160
152c, 156c
156a
152
124b
148
152b
152a
104b
A
152d
120a
156
164
104d
156b
164
156d
112
120
136
144
112a
164
120b
164
104a
152d
152d
104c
152b
152b
116a
140
116b
152
152a
152a
152
152c, 156c
152c, 156c
164
160
156d 164
160
156
156b
156d
116
156a
156b
156a
156

WINDOW HAVING HINGED CORNER ARRANGEMENT

FIELD OF THE DISCLOSURE

The present disclosure generally relates to windows and, more particularly, to storm windows having hinged corners.

BACKGROUND

Windows on structures such as houses typically are lacking in thermal and sound insulative properties. Often, to address the short comings of these windows, storm windows are placed inside and/or outside of the window. Storm windows can improve thermal insulation as well as sound proofing by providing a pocket of air between the existing window and the storm window. Storm windows also can provide the added benefit of an added layer of protection from the elements (e.g., severe storms, hail, wind, debris, etc.), which is especially useful in older houses or houses having older windows and/or poor insulation. Conveniently, storm windows may be installed during construction of the house or, more frequently, may be installed after the house is built and problems arise with heat loss and/or lack of thermal comfort.

Typically, houses settle over time and shift slightly from its original position. These shifts may damage windows and/or window frames, and thus may create areas of air leakage into the home which in turn may create heat loss and allow more noise to enter the house. When these shifts occur, the frame holding the glass may go "out of square." When window frames become "out of square" it oftentimes may be more difficult and time consuming to properly manufacture, frame, and/or install new storm windows on the structure.

SUMMARY

In accordance with a second aspect, a frame for a window includes a first rail, a second rail, a third rail, a fourth rail, a first pivotable bracket member coupling the first and second rails, and a second pivotable bracket member coupling the third and fourth rails. The first rail includes a first end, a second end, and a first groove extending a distance between the first end and the second end thereof. The second rail includes a first end, a second end, and a second groove extending a distance between the first end and the second end thereof. The third rail includes a first end, a second end, and a third groove extending a distance between the first end and the second end thereof. The fourth rail includes a first end, a second end, and a fourth groove extending a distance between the first end and the second end thereof.

In some examples, at least one of the pivotable bracket members includes a first member, a second member, and a first fastener. The first member has a first portion and a second portion and is positioned near the first end of the first rail. Further the first member is at least partially disposed within the first groove. The second member has a first portion and a second portion, and is positioned near the second end of the second rail. The second member is at least partially disposed within the second groove. The first fastener pivotably couples the first and second members. When the first and second members are coupled to each other, the first portion of the first member overlaps the first portion of the second member.

In some of these examples, the second portion of the first member is raised relative to the first portion of the first member. The First portion of the second member may be flush with the second portion of the first member when the first and the second members are coupled to each other.

In some forms, the frame may further include at least one cover hingedly mounted to one of the first rail, the second rail, the third rail, or the fourth rail. The at least one cover is positionable between a released position where the frame receives a window pane and an engaged position where the window pane is secured to the frame. The at least one cover and the frame may cooperate to define a cavity to accommodate the window pane.

In some examples, the frame may further include a third pivotable bracket member and a fourth pivotable bracket member.

In accordance with a second aspect, a structural assembly for a frame includes a first rail, a second rail, and a pivotable bracket member. The first rail includes a first end, a second end, and a first groove extending a distance between the first end and the second end thereof. The second rail includes a first end, a second end, and a second groove extending a distance between the first end and the second end. The second rail is adapted to abut the first rail and the pivotable bracket member is adapted to pivotably couple the first rail with the second rail.

In some examples, the pivotable bracket member can include a first member, a second member, and a fastener. The first member may be positioned near the first end of the first rail and be at least partially disposed within the first groove, and can include a first portion and a second portion. The second member may be positioned near the second end of the second rail and be at least partially disposed within the second groove and can include a first portion and a second portion. The first fastener pivotably couples the first and second members. When the first member is coupled to the second member, the first portion of the first member overlaps the first portion of the second member.

In some of these examples, the second portion of the first member is raised relative to the first portion of the first member. Further, the first portion of the second member can be flush with the second portion of the first member when the first and second members are coupled to each other.

In some forms, the first member further includes a first aperture disposed in the first portion that receives the first fastener and a second aperture disposed in the second portion that receives a second fastener. The second fastener couples the first member to the first rail. Further, the second member may include a first aperture and a second aperture. The first aperture is disposed in the first portion and receives the first fastener, and the second aperture is disposed in the second portion and receives a third fastener. The third fastener couples the second member to the second rail.

In some of these examples, the structural assembly may further include a first platform disposed in the first groove and a second platform in the second groove. In some examples, the second member may further include an angled region positioned between the first portion and the second portion.

In some forms, the first end of the first rail and the second end of the second rail are rotatable relative to each other such that the first end of the first rail and the second end of the second rail abut at an angle less than approximately 90 degrees. Further, the second portion of the first member is operably coupled to the first platform and the second portion of the second member is operably coupled to the second platform. In other examples, the first end of the first rail and the second end of the second rail are rotatable relative to each other such that the first end of the first rail and the second end of the second rail abut at an angle greater than approximately 90 degrees.

BRIEF DESCRIPTION OF THE DRAWINGS

The above needs are at least partially met through provision of the window having hinged corners described in the following detailed description, particularly when studied in conjunction with the drawings, wherein.

Figure 1:
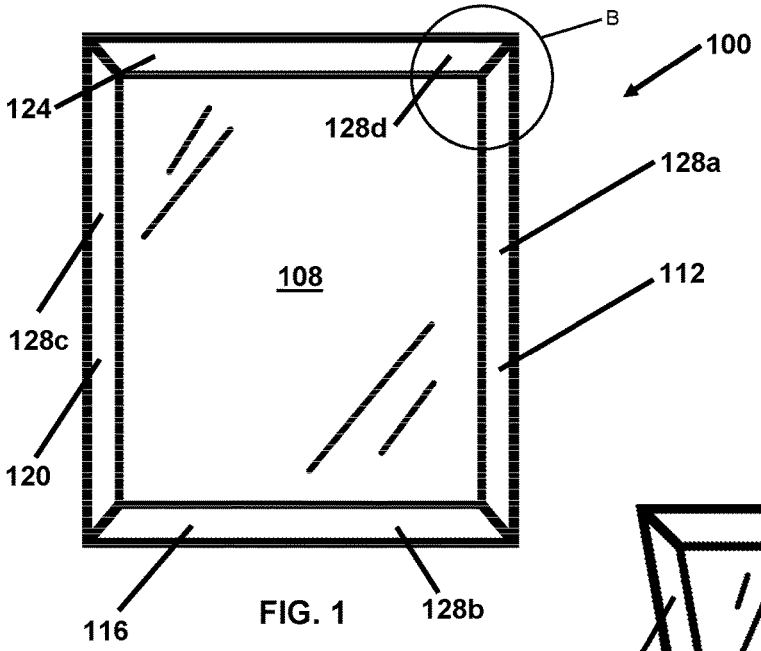
FIG. 1 illustrates a front elevation view of an example frame for a window in an assembled view, constructed in accordance with various embodiments.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by person skilled in the technical field as set forth above except where different specific meanings have otherwise been set forth herein.

DETAILED DESCRIPTION

The present disclosure is generally directed to a storm window frame having hinged corners. Typically, storm windows include a frame that surrounds a pane (e.g., a glass member, an acrylic member, a polycarbonate member, or any other suitable material) which are both placed within the frame of an existing window in, for example, a house, to increase the thermal insulation and/or sound proofing of the existing window. Prior to placement of the window, various measurements of the frame surrounding the window should be taken to ensure proper sizing of the storm window because most frames are not exactly rectangular. This can be as a result of various factors, such as, for example, the house settling and exerting a shear force on the frame that can cause the frame to no longer be rectangular. Thus, most frames have a parallelogram shape rather than a rectangular shape.

Typically, to compensate for the frame being a parallelogram rather than a rectangle, multiple measurements of the frame are taken before installation of the storm window. For example, a horizontal measurement, a vertical measurement, and multiple diagonal measurements may be taken in order to ensure the correct dimensions of the storm window. These measurements are beneficial because known storm window designs typically do not have the ability to be manipulated and reshaped at the point of installation if the frame is no longer rectangular. This results in greater costs for such windows due to the precise and unique shape of each storm window manufactured.

The present disclosure addresses these and other problems by providing a frame for a storm window having hinged corners which allow the frame to adjust to out-of-square, or parallelogram, shaped windows. The frame having hinged corners of the present invention only requires two measurements (e.g., the horizontal distance and the vertical distance), rendering the diagonal measurements unnecessary because the hinged corners allow for the frame to be manipulated at the point of installation to fit the existing, out-of-square frame. The present invention forms a frame using four rails, each rail being coupled to an adjacent rail via a pivotable bracket member. The pivotable bracket member allows each rail to be positioned within an existing frame so that each rail properly rests against each side of the existing frame. Once each rail is positioned, the pivotable bracket members are secured via an attachment mechanism, the pane is placed within the frame, and the pane is then secured to the frame.

The present invention also allows for the pane to be substantially rectangular rather than be purposefully cut to the shape of a parallelogram. This allows for a simpler manufacturing process because the panes or lenses will not need to be cut to such particular measurements and with such precision.

Figure 2:
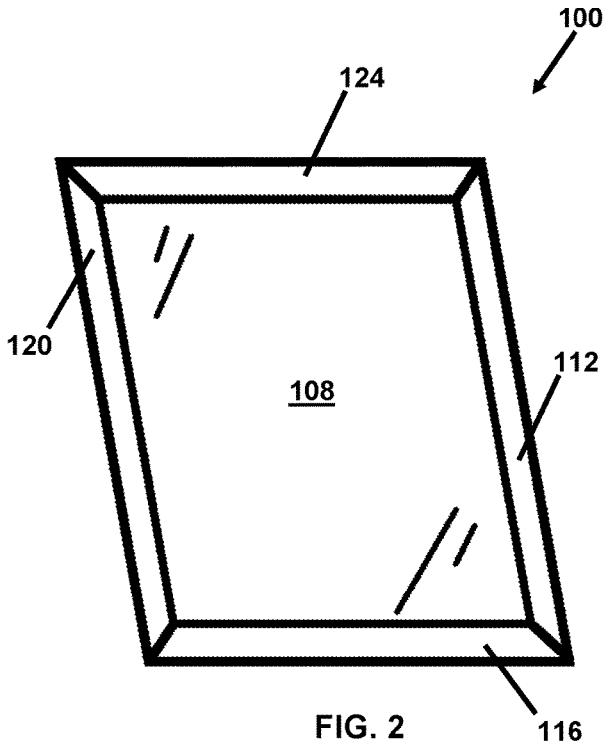
FIG. 2 illustrates a front elevation view of the example frame of FIG. 1 in a first shear position, constructed in accordance with various embodiments.
Figure 3:
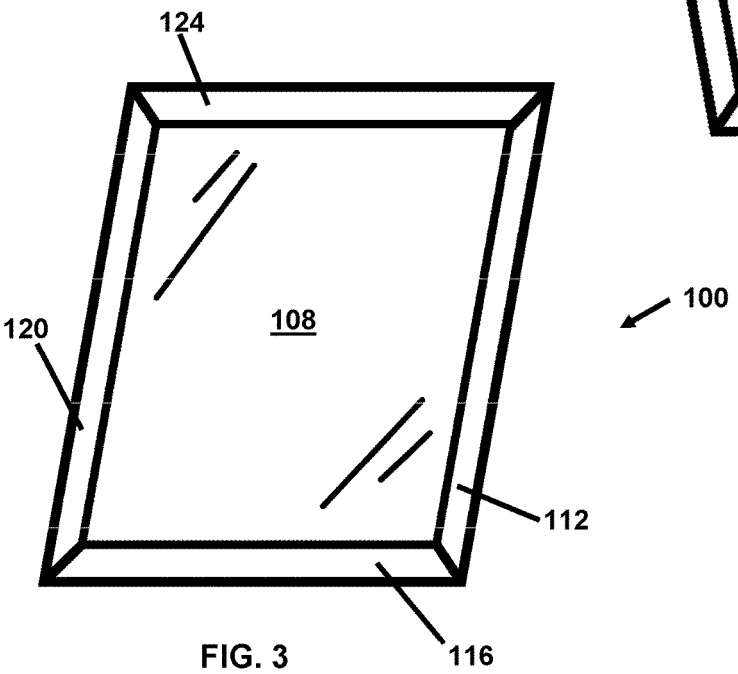
FIG. 3 illustrates a front elevation view of the example frame of FIG. 1 in a second shear position, constructed in accordance with various embodiments.

An embodiment of a frame 100 having hinged, pivotable bracket members 104 (referred to as 104*a*, 104*b*, 104*c*, and 104*d* herein and in the Figures) disposed at corners is illustrated in FIGS. 1-5. In particular, FIGS. 1-3 illustrate the frame 100 in various configurations: FIG. 1 illustrates the frame 100 in a neutral configuration; FIG. 2 illustrates the frame 100 in a first shear configuration; and FIG. 3 illustrates the frame 100 in a second shear configuration. The pivotable bracket members 104 retain the frame 100 between the neutral, the first shear, and the second shear configurations because of multiple pivotable bracket members that retain the frame in the various configurations. Once the multiple pivotable bracket members 104 secure the frame in either the neutral, first shear, or second shear configuration, a pane (e.g., glass, acrylic, etc.) 108 is secured to the frame 100.

The frame 100 is constructed from and includes a first rail 112, a second rail 116, a third rail 120, and a fourth rail 124. Each of the rails 112, 116, 120, 124 are operably coupled together using the pivotable bracket members 104. In particular, a first pivotable bracket member 104*a* couples the first and second rails 112, 116, a second pivotable bracket member 104*b* operably couples the third and fourth rails 120, 124, a third pivotable bracket member 104*c* operably couples the second and third rails 116, 120, and a fourth pivotable bracket member 104*d* operably couples the first and fourth rails 112, 124. Further, and as illustrated in FIG. 1, each of the first, second, third, and fourth rails 112, 116, 120, 124 may include a respective cover hingedly attached thereto. In particular, a first cover 128*a* is hingedly coupled to the first rail 112, a second cover 128*b* is hingedly coupled to the second rail 116, a third cover 128*c* is hingedly coupled to the third rail 120, and a fourth cover 128*d* is hingedly coupled to the fourth rail 124. Each cover is positionable between a released position, where a pane 108 may be placed within a perimeter of the frame 100, and an engaged position, where the pane 108 is secured to the frame 100. Put differently, the cover members 128*a*, 128*b*, 128*c*, 128*d* cooperate with the rails to define a cavity that receives the pane 108. It is appreciated that any number of suitable cover members may be used having varying mechanisms to secure the pane 108 such as, for example, cover members that include a resilient member that urges the cover to the engaged position. The cover members may be dimensioned such that the cavity for receiving the pane 108 is larger than the pane 108 so a gap or clearance between approximately 0.5 mm and approximately 5.0 mm is formed between an outer edge of the pane 108 and each of the rails.

As previously mentioned, the pane 108 may be constructed from glass, acrylic, polycarbonate, or any other suitable material or materials. The pane 108 may be transparent, translucent, and/or opaque.

Figure 4:
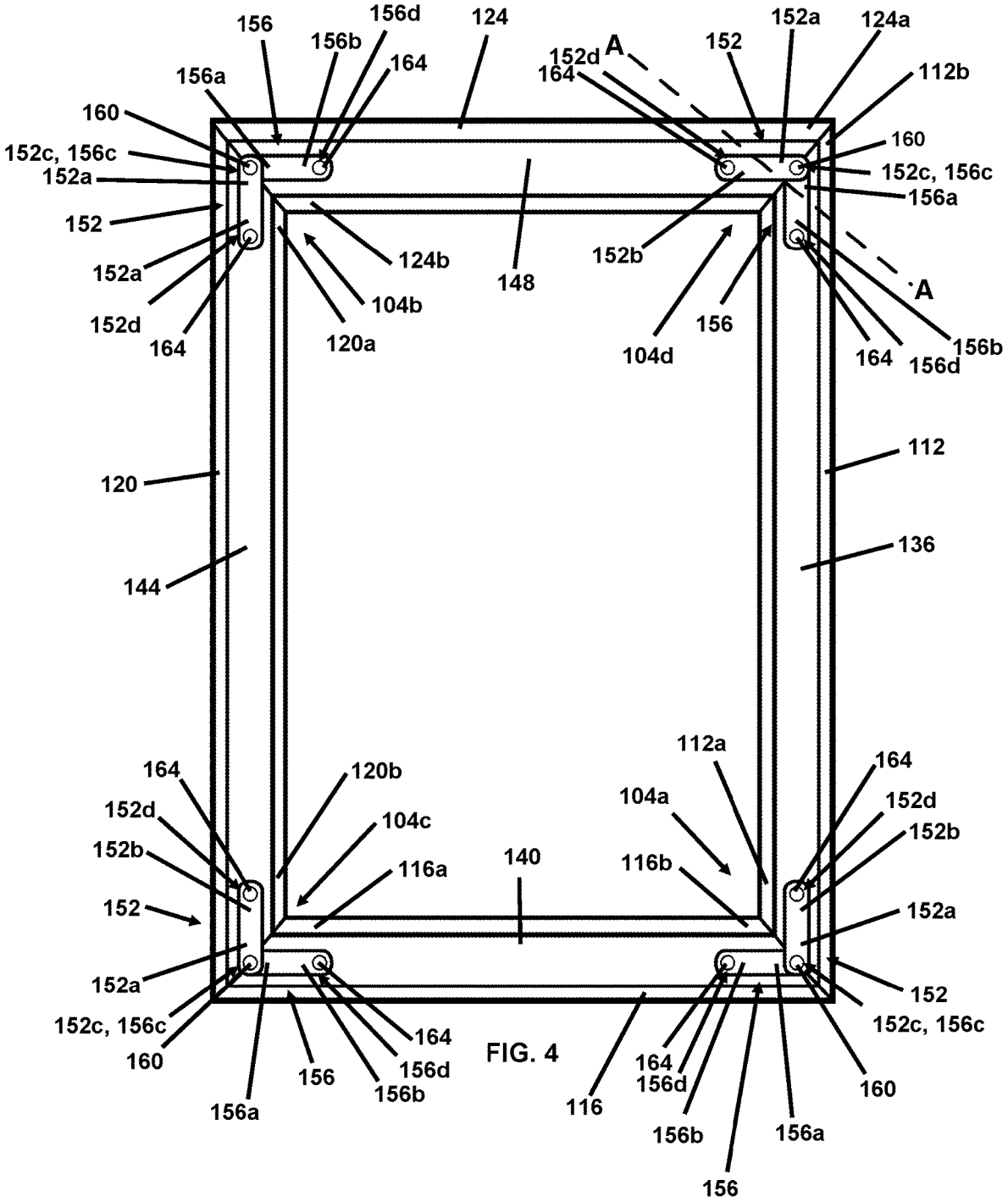
FIG. 4 illustrates a rear elevation view of the example frame of FIG. 1 constructed in accordance with various embodiments.

As illustrated in FIG. 4, the first, second, third, and fourth rails 112, 116, 120, 124 are coupled via the first, second, third, and fourth pivotable bracket members 104*a*-*d*. The first rail 112 includes a first end 112*a*, a second end 112*b*, and a first groove 136 that extends a distance between the first end 112*a* and the second end 112*b*. The second rail 116 includes a first end 116*a*, a second end 116*b*, and a second groove 140 that extends a distance between the first end 116*a* and the second end 116*b*. The second rail 116 is also adapted to abut the first rail 112. The third rail 120 includes a first end 120*a*, a second end 120*b*, and a third groove 144 that extends a distance between the first end 120*a* and the second end 120*b*. The third rail 120 is also adapted to abut the second rail 116. The fourth rail 124 includes a first end 124*a*, a second end 124*b*, and a fourth groove 148 that extends a distance between the first end 124*a* and the second end 124*b*. The fourth rail 124 is also adapted to abut the third rail 120.

The pivotable bracket members 104*a*, 104*b*, 104*c*, 104*d* are disposed between and couple the rails to form the frame 100, as discussed above. Each pivotable bracket member 104*a*, 104*b*, 104*c*, 104*d* may include a plurality of members and fasteners that couple to the plurality of members together and to the respective rails once the frame is positioned properly. In particular, the pivotable bracket members include a first member 152 having a first portion 152*a*, a second portion 152*b*, a first aperture 152*c*, and a second aperture 152*d*, a second member 156 having a first portion 156*a*, a second portion 156*b*, a first aperture 156*c*, and a second aperture 156*d*, and a fastener 160 that pivotably couples the first and second members 152, 156 at respective first apertures 152*c*, 156*c* (see FIG. 5). Further, the second member 156 includes an angled region 156*e* extending between the first and second portions 156*a*, 156*b*

Referring now to the first pivotable bracket member 104*a*, the first member 152 thereof may be positioned near the first end 112*a* of the first rail 112 and may further be at least partially disposed within the first groove 136 of the first rail 112. Similarly, the second member 156 may be positioned near the second end 116*b* of the second rail 116 and may further be at least partially disposed within the second groove 140 of the second rail 116. While not shown, each of the grooves 136, 140, 144, 148 may be dimensioned to closely match a width of the respective first or second member 152, 156 to create a snug fit having minimal "play".

Each of the first and second members 152, 156 may be coupled to the first rail 112 and second rail 116, respectively, using any number of suitable attachment mechanisms. For example, the first member 152 can be coupled to the first rail using a fastener 164 (such as, for example, a screw) inserted through an aperture 152*d* formed through the first member 152, and the second member 156 can also be coupled to the second rail using a fastener 164 inserted through an aperture 156*d* formed through the second member 156. However, in other examples, the first and second members 152, 156 can be coupled to the first and second rails 112, 116, respectively, using an adhesive, a tongue and groove joint, a snap fit connector, etc. Further, in some examples, the first and second members 152, 156 can be coupled to the first and second rails 112, 116, respectively, using a similar attachment mechanism. In other examples, the first and second members 152, 156 can be coupled to the first and second rails 112, 116, respectively, using different attachment mechanisms.

Referring now to the second pivotable bracket member 104*b*, the first member 152 thereof may be positioned near the first end 120*a* of the third rail 120 and may further be at least partially disposed within the third groove 144 of the third rail 120. Similarly, the second member 156 may be positioned near the second end 124*b* of the fourth rail 124 and may further be at least partially disposed within the fourth groove 148 of the fourth rail 124. Each of the first and second members 152, 156 may be coupled to the third rail 120 and the fourth rail 124, respectively, using any suitable attachment mechanism, such as the previously-described approaches, which can include the fasteners 164.

Referring now to the third pivotable bracket member 104*c*, the first member 156 thereof may be positioned near the second end 120*b* of the third rail 120 and may further be at least partially disposed within the third groove 144 of the third rail 120. Similarly, the second member 156 may be positioned near the first end 116*a* of the second rail 116 and may further be at least partially disposed within the second groove of the second rail 116. Each of the first and second members 152, 156 may be coupled to the third rail 120 and the second rail 116, respectively, using any suitable attachment mechanism, such as the previously-described approaches, which can include the fasteners 164.

Referring now to the fourth pivotable bracket member 104*d*, the first member 152 thereof may be positioned near the first end 124*a* of the fourth rail 124 and may further be at least partially disposed within the fourth groove 144 of the fourth rail 124. Similarly, the second member 156 may be positioned near the second end 112*a* of the first rail 112 and may further be at least partially disposed within the first groove 136 of the first rail 112. Each of the first and second members 152, 156 may be coupled to the fourth rail 124 and the first rail 112, respectively, using any suitable attachment mechanism, such as the previously-described approaches, which can include the fasteners 164.

Figure 5:
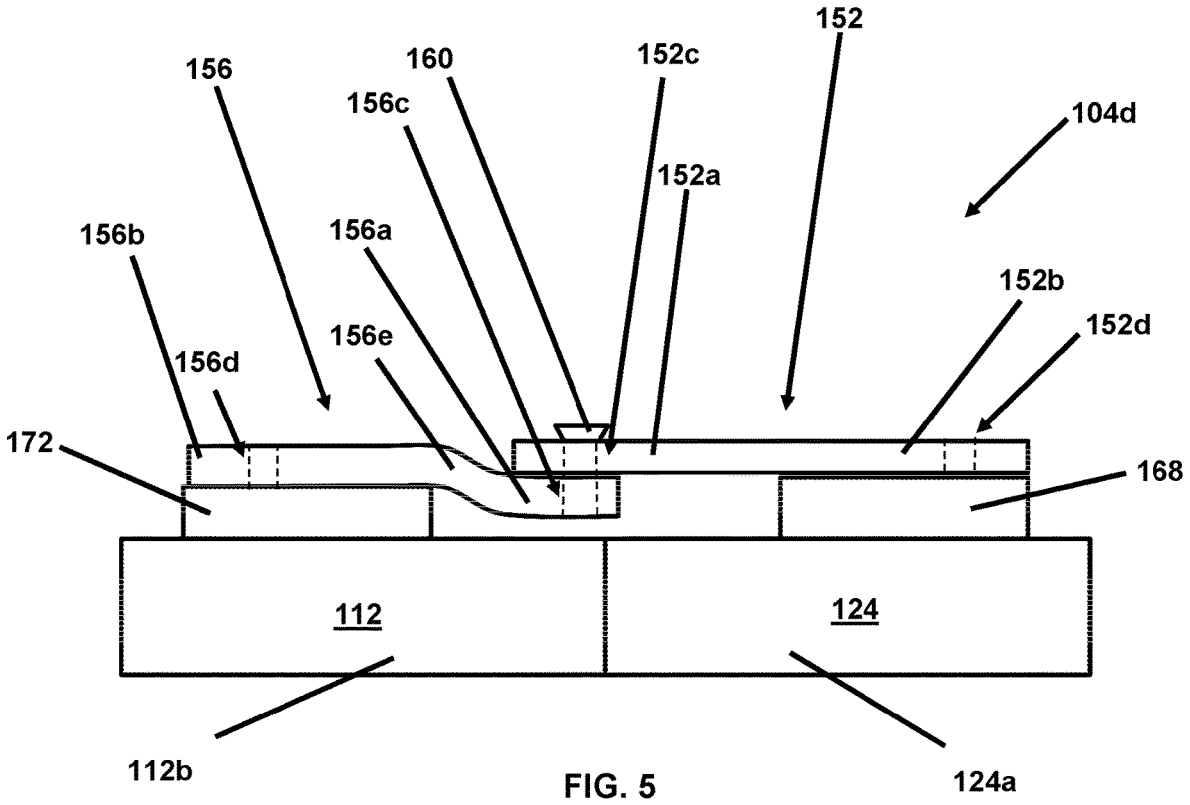
FIG. 5 illustrates a side elevation view of a structural assembly for a frame taken along line A-A in FIG. 4, constructed in accordance with various embodiments.

FIG. 5 illustrates an example embodiment of the pivotable bracket member coupling two rails. In particular, the example embodiment illustrated in FIG. 5 includes the fourth pivotable bracket member 104*d* coupling the first rail 112 and the fourth rail 124. In the embodiment illustrated in FIG. 5, the first and second portions 152*a*, 152*b* of the first member 152 are substantially parallel while the second portion 156*b* of the second member 156 is raised relative to the first portion 156*a* of the second member 156 due to the angled portion 156*e* disposed on the second member 156. Such a configuration allows the first member 152 to sit flush with the second portion 156*b* of the second member 156. In other words, the first member 152 overlaps a portion of the second member 156 when the first and second members 152, 156 are coupled via the fastener 160. While FIG. 5 illustrates one embodiment of the fourth pivotable bracket member 104*d*, other embodiments may have different configurations. For example, the first and second portions 156*a*, 156*b* of the second member 156 can be substantially parallel while the second portion 152*b* of the first member 152 is raised relative to the first portion 152*a* of the first member 152.

Additionally, FIG. 5 illustrates a first platform 168 disposed on the fourth rail 124 and a second platform 172 disposed on the first rail 112. The first and second platforms 168, 172 raise the first and second members 152, 156 so that the first and second members 152, 156 may overlap in the manner described above. In particular, the first platform 168 may be disposed within the fourth groove 148 of the fourth rail 124 and the second platform 172 may be disposed within the first groove 136 of the first rail 112. In the embodiment illustrated in FIG. 5, the second platform 172 has a height that raises the second member 156 a distance from the first rail 112 such that the second portion 156*b* of the second member 156 may be raised relative to the first portion 156*a*. In turn, the first platform 168 has a height that compliments the height of the second platform 172. Specifically, the first platform 168 has a height that raises the first member 152 a distance from the fourth rail 124 such that the first member 152 is flush with the second portion 156*b* of the second member 156.

Figure 6:
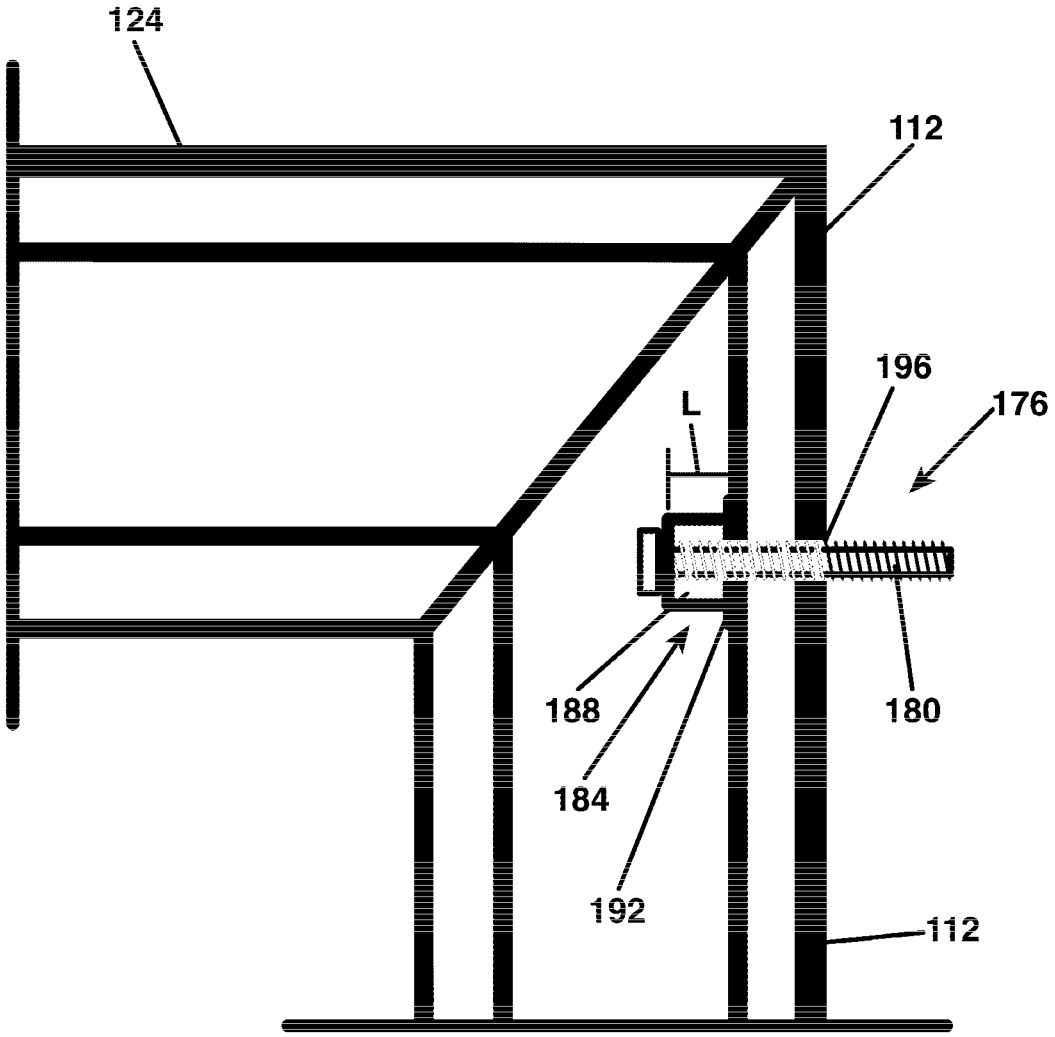
FIG. 6 illustrates a detailed, front elevation view of the example frame of FIG. 1 within circle B in FIG. 1 with a cover removed, constructed in accordance with various embodiments.

FIG. 6 illustrates an example gripping element 176 disposed within the frame 100. In operation, the gripping element 176 releasably secures any number of the first rail 112, the second rail 116, the third rail 120, or the fourth rail 124 to a head or a jamb of a window (not shown) without the need for pre-drilling into the head or jamb. So configured, the gripping element 176 releasably secures the frame 100 with the window to prevent the frame 100 from being forced out of the window due to pressure fluctuations in the space between the window and the frame 100. Additionally, damage to the head or the jamb of the window may be minimized because the gripping element 176 engages the head or the jamb of the window without drilling.

In particular, FIG. 6 illustrates the gripping element 176, the first rail 112, and the fourth rail 124. In the example illustrated in FIG. 6, the gripping element 176 includes a fastener 180 and an elongated cylinder 184. The elongated cylinder 184 has an outer surface 188, a threaded inner surface, and a length L. In some examples, such as the one illustrated in FIG. 6, an end of the elongated cylinder 184 can include a lip 192. The elongated cylinder 184 may be fixedly secured anywhere along the first, second, third, and/or fourth rails 112, 116, 120, 124 that adequately supports the frame 100. For example, as illustrated in FIG. 6, the elongated cylinder 184 can be fixedly secured toward the second end 112*b* of the first rail 112. More specifically, the elongated cylinder 184 is fixedly secured toward the second end 112*b* of the first rail 112 such that the elongated cylinder 184 is concentric with an aperture 196 disposed in the first rail 112. So configured, the fastener 180 may pass through both the elongated cylinder 184 and the aperture 196 to engage the head and/or the jamb of the window. The fastener 180 may be a threaded screw, as illustrated in FIG. 6. The fastener 180 has a length such that the fastener 180 passes through both the elongated cylinder 184 and the first, second, third, or fourth rail 112, 116, 120, 124 before engaging either the head or jamb of the window. Additionally, in some examples, such as the one illustrated in FIG. 6, the fastener 180 includes a flat end so as not to damage or penetrate the head or jamb of the window. While the fastener 180 has thus far been described and illustrated as a screw, the fastener 180 may be in the form of any securement mechanism.

In operation, the gripping element 176 secures the frame 100 to the head or jamb of the window after the frame 100 is properly placed within the window, as extensively discussed above. Once the frame 100 is in position, the fastener 180, which may be pre-threaded to the elongated cylinder 184, is tightened until the fastener 180 makes contact with either the head or the jamb of the window. This same process may be repeated to each gripping element 176 disposed within the frame 100 until the fasteners 180 of each gripping element 176 disposed within the frame 100 securely engages the head or jamb of the window.

In some examples, all or a portion of a perimeter of the frame 100 may include an insulative material such as, for example, a compressible gasket or seal member such as rubber, silicone, and the like that may be used to form a seal with the structural frame or opening in which the frame 100 is disposed. During installation, the compressible gasket or seal member may create a friction-fit coupling with the window cavity. Accordingly, in these examples, the pivotable bracket members 104 may not need to be secured or otherwise tightened. In other examples, during the installation process, each of the pivotable bracket members 104*a*-104*d* may be unlocked and loose, thereby allowing for the frame members to tilt and adjust to fit within the frame pocket. Further, in some examples, once the frame 100 is installed into the window frame cavity, the pivotable bracket members may be tightened so that if the frame 100 is removed, it will retain the shape of the particular window frame cavity for reinstallation. It should be noted that while the foregoing discussion regards the fourth pivotable bracket member 104*d*, each of the features discussed are applicable to the first pivotable bracket member 104*a*, the second pivotable bracket member 104*b*, and/or the third pivotable bracket member 104*c*.

So configured, the pivotable bracket members 104*a*-104*d* allow for the frame 100 to shift to accommodate out-of-square panes 108 and/or in response to settling or shifting of the structure. Put differently, the pivotable bracket members described herein allow the rail members to abut each other at angles greater or less than approximately 90 degrees. In some examples and configurations, the frame 100 may only use two pivotable bracket members (positioned, for example, at opposite corners) to accommodate out-of-square panes and/or in response to settling of the structure.

Additionally, by dimensioning the cover members 128*a*, 128*b*, 128*c*, 128*d* such that the cavity formed with the rails is larger than the pane 108, the frame 100 may continue to cover and retain the pane 108 if the frame 100 shifts to an "out of square" shape when in the window cavity. In other words, while the frame 100 may pivot due to the structure settling, the gap formed in the cavity ensures the pane 108 does not incur additional potentially damaging forces thereon. Notably, the present application does not require precise measurements of an out of square window cavity due to no longer needing to dimension and shape the window frame to the parallelogram shape of the cavity. Accordingly, the present application reduces manufacturing complexities due to the ability to use conventionally cut window panes having 90° corners that fit into the slightly larger cavity of the frame (which may be parallelogram in shape).

Those skilled in the art will recognize that a wide variety of modifications, alterations, and combinations can be made with respect to the above described examples without departing from the scope of the disclosure, and that such modifications, alterations, and combinations are to be viewed as being within the ambit of the inventive concept.

The patent claims at the end of this patent application are not intended to be construed under 35 U.S.C. § 112(f) unless traditional means-plus-function language is expressly recited, such as "means for" or "step for" language being explicitly recited in the claim(s).

I claim:

1. A structural assembly for a frame of a window, the structural assembly comprising:

a first rail having a first end, a second end, and a first groove defined within a surface of the first rail and extending a distance between the first end and the second end thereof;

a second rail having a first end, a second end, and a second groove defined within a surface of the second rail and extending a distance between the first end and the second end, the first end of the second rail abutting the second end of the first rail;

a first platform disposed on the first rail and a second platform disposed on the second rail; and a pivotable bracket member pivotably coupling the first rail with the second rail relative to one another, the pivotable bracket member being secured to the first platform and the second platform via a plurality of fasteners, wherein each of the first groove and the second groove receives the first platform and the second platform, respectively, such that each of the plurality of fasteners extends through an upper surface of the pivotable bracket member through the respective first and second platforms, and into a portion of the first groove and a portion of the second groove, respectively.

2. The structural assembly of claim 1, wherein the pivotable bracket member comprises:

a first member positioned near the first end of the first rail and being at least partially disposed within the first groove, the first member having a first portion and a second portion, a second member positioned near the second end of the second rail and being at least partially disposed within the second groove, the second member having a first portion and a second portion, and a first fastener pivotably coupling the first and second members, wherein when the first member is coupled to the second member, the first portion of the first member overlaps the first portion of the second member.

3. The structural assembly of claim 2, wherein the second portion of the first member is raised relative to the first portion of the first member.

4. The structural assembly of claim 3, wherein the first portion of the second member is flush with the second portion of the first member when the first and second members are coupled to each other.

5. The structural assembly of claim 2, wherein the first member further comprises:

a first aperture disposed in the first portion and adapted to receive the first fastener; and a second aperture disposed in the second portion and adapted to receive a first fastener of the plurality of fasteners, wherein the first fastener of the plurality of fasteners couples the first member to the first rail.

6. The structural assembly of claim 5, wherein the second member further comprises:

a first aperture disposed in the first portion and adapted to receive the first fastener; and a second aperture disposed in the second portion and adapted to receive a second fastener of the plurality of fasteners, wherein the second fastener of the plurality of fasteners couples the second member to the second rail.

7. The structural assembly of claim 2, wherein the second member further comprises an angled region positioned between the first portion and the second portion.

8. The structural assembly of claim 1, wherein the first end of the first rail and the second end of the second rail are rotatable relative to each other such that the first end of the first rail and the second end of the second rail abut at an angle less than approximately 90 degrees.

9. The structural assembly of claim 1, wherein the first end of the first rail and the second end of the second rail are rotatable relative to each other such that the first end of the first rail and the second end of the second rail abut at an angle greater than approximately 90 degrees.

10. The structural assembly of claim 1, further comprising:

at least one gripping element disposed in any one of the first rail or the second rail, the at least one gripping element configured to releasably secure the first rail or the second rail to a head or a jamb of a window.

11. The structural assembly of claim 10, wherein each of the at least one gripping element comprises a fastener and an elongated cylinder adapted to threadably receive the fastener, the elongated cylinder being fixedly attached to any one of the first rail or the second rail such that the elongated cylinder is concentric with an aperture in the first rail or the second rail.

12. A frame for a window, the frame comprising:

a first rail having a first end, a second end, and a first groove defined within a surface of the first rail and extending a distance between the first end and the second end thereof;

a second rail having a first end, a second end, and a second groove defined within a surface of the second rail and extending a distance between the first end and the second end, the first end of the second rail abutting the second end of the first rail;

a third rail having a first end, a second end, and a third groove extending a distance between the first end and the second end thereof, the third rail adapted to abut the second rail;

a fourth rail having a first end, a second end, and a fourth groove extending a distance between the first end and the second end;

a first pivotable bracket member pivotably coupling the first and second rails relative to one another, the first pivotable bracket member being disposed on a first platform and a second platform, wherein the first platform is secured to the first groove of the first rail and the second platform is secured to the second groove of the second rail via respective fasteners passing through the first pivotable bracket, the first and second platforms, and into a portion of the first groove and second groove of the first and second rails, respectively; and a second pivotable bracket member adapted to couple the third and fourth rails, the second pivotable bracket member being disposed on a third platform and a fourth platform, wherein the third platform is secured to the third rail and the second platform is secured to the third and fourth rail rails via respective fasteners passing through the second pivotable bracket member, the third and fourth platforms, and into a portion of the third and fourth rails, respectively.

13. The frame of claim 12, wherein the first pivotable bracket member comprises:

a first member positioned near the first end of the first rail and being at least partially disposed within the first groove, the first member having a first portion and a second portion, a second member positioned near the second end of the second rail and being at least partially disposed within the second groove, the second member having a first portion and a second portion, and a first fastener pivotably coupling the first and second members;

wherein when the first member is coupled to the second member, the first portion of the first member overlaps the first portion of the second member; and the second pivotable bracket member comprises:

a first member positioned near the first end of the third rail and being at least partially disposed within the third groove, the first member having a first portion and a second portion, a second member positioned near the second end of the fourth rail and being at least partially disposed within the fourth groove, the second member having a first portion and a second portion, and a second fastener pivotably coupling the first and second members;

wherein when the first member of the second pivotable bracket member is coupled to the second member of the second pivotable bracket member, the first portion of the first member of the second pivotable bracket member overlaps the first portion of the second member of the second pivotable bracket member.

14. The frame of claim 13, wherein the second portion of the first member of each pivotable bracket member is raised relative to the first portion of the first member of each respective pivotable bracket member.

15. The frame of claim 14, wherein the first portion of the second member of each pivotable bracket member is flush with the second portion of the first member of each respective pivotable bracket member when the first and second members of each respective pivotable bracket member are coupled to each other.

16. The frame of claim 12, further comprising at least one cover hingedly mounted to one of the first rail, the second rail, the third rail, and the fourth rail, wherein the at least one cover is positionable between a released position where the frame receives a window pane, and an engaged position where the window pane is secured to the frame.

17. The frame of claim 16, wherein the at least one cover and the frame cooperate to define a cavity to accommodate the window pane.

18. The frame of claim 12, further comprising a third pivotable bracket member and a fourth pivotable bracket member, wherein the third pivotable bracket member couples the third rail and the second rail and the fourth pivotable bracket member couples the fourth rail and the first rail.

19. The frame of claim 18, wherein the third pivotable bracket member comprises:

a first member positioned near the second end of the third rail and being at least partially disposed within the third groove, the first member having a first portion and a second portion, a second member positioned near the first end of the second rail and being at least partially disposed within the second groove, the second member having a first portion and a second portion, and a fastener pivotably coupling the first and second members, wherein when the first member is coupled to the second member, the first portion of the first member overlaps the first portion of the second member; and the fourth pivotable bracket member comprises:

a first member positioned near the first end of the fourth rail and being at least partially disposed within the fourth groove, the first member having a first portion and a second portion, a second member positioned near the second end of the first rail and being at least partially disposed within the first groove, the second member having a first portion and a second portion, and a fastener pivotably coupling the first and second members, wherein when the first member of the fourth pivotable bracket member is coupled to the second member of the fourth pivotable bracket member, the first portion of the first member of the fourth pivotable bracket member overlaps the first portion of the second member of the fourth pivotable bracket member.

20. The frame of claim 19, wherein the second portion of the first member of the third and fourth pivotable bracket members is raised relative to the first portion of the first member of the respective third and fourth pivotable bracket member.

21. The frame of claim 20, wherein the first portion of the second member of the third and fourth pivotable bracket members is flush with the second portion of the first member of the respective third and fourth bracket member when the first and second members of the respective third and fourth bracket members are coupled to each other.

22. The frame of claim 12, further comprising:

at least one gripping element disposed in any one of the first rail, the second rail, the third rail, or the fourth rail, the at least one gripping element configured to releasably secure the first rail, the second rail, the third rail, or the fourth rail to a head or a jamb of a window.

23. The frame of claim 22, wherein each of the at least one gripping element comprises a fastener and an elongated cylinder adapted to threadably receive the fastener, the elongated cylinder being fixedly attached to any one of the first rail, the second rail, the third rail, or the fourth rail such that the elongated cylinder is concentric with an aperture in the first rail, the second rail, the third rail, or the fourth rail.

* * * * *